US010883714B2

(12) United States Patent
Liu

(10) Patent No.: US 10,883,714 B2
(45) Date of Patent: Jan. 5, 2021

(54) STOVE, FLAME PORT STRUCTURE DISPOSED IN A STOVE AND METHOD OF MAKING FLAME PORT STRUCTURE

(71) Applicant: Sunny Liu, Taichung (TW)

(72) Inventor: Sunny Liu, Taichung (TW)

( * ) Notice: Subject to any disclaimer, the term of this patent is extended or adjusted under 35 U.S.C. 154(b) by 211 days.

(21) Appl. No.: 16/203,399

(22) Filed: Nov. 28, 2018

(65) Prior Publication Data

US 2019/0301733 A1 Oct. 3, 2019

(30) Foreign Application Priority Data

Apr. 3, 2018 (TW) ..... 107111984 A
Apr. 3, 2018 (TW) ..... 107204480 A

(51) Int. Cl.

| | |
|---|---|
| ***F23D 14/06*** | (2006.01) |
| ***F23D 14/58*** | (2006.01) |
| ***B21D 11/06*** | (2006.01) |
| ***B21D 13/10*** | (2006.01) |
| ***B21D 35/00*** | (2006.01) |
| ***B21D 47/00*** | (2006.01) |
| ***B21D 13/02*** | (2006.01) |

(52) U.S. Cl.

CPC ..... *F23D 14/586* (2013.01); *B21D 11/06* (2013.01); *B21D 13/02* (2013.01); *B21D 13/10* (2013.01); *B21D 35/001* (2013.01); *B21D 47/00* (2013.01); *F23D 14/06* (2013.01); *F23D 2203/106* (2013.01); *F23D 2203/108* (2013.01); *F23D 2203/1012* (2013.01); *F23D 2203/1026* (2013.01)

(58) Field of Classification Search

CPC ..... B21D 13/00; B21D 11/06; B21D 11/10; B21D 35/001; B21D 13/02; B21D 13/10; B21D 47/00; B21D 53/00; F23D 14/06; F23D 14/586; F23D 2203/106; F23D 2203/1012; F23D 2203/1026; F23D 2203/108

See application file for complete search history.

(56) References Cited

U.S. PATENT DOCUMENTS 2,235,635 A * 3/1941 Herman ..... F23D 14/065 239/555
2,901,033 A * 8/1959 Holden ..... F23D 14/26 431/349
3,088,271 A * 5/1963 Smith ..... F01N 3/06 422/177

(Continued)

*Primary Examiner* — Alfred Basichas
(74) *Attorney, Agent, or Firm* — Haverstock & Owens LLP

(57) ABSTRACT

A flame port structure for burning a gas includes a first continuous spiral strip, a second continuous spiral strip and a first outflow passage. The first continuous spiral strip has a first side edge, a second side edge and a first plurality of annular segments, and the second continuous spiral strip has a third side edge, a fourth side edge and a second plurality of annular segments, wherein each of the first plurality of annular segments and each of the second plurality of annular segments respectively have two first longitudinal opposite surfaces and two second longitudinal opposite surfaces. The first outflow passage has a first defining wall formed on each of the first respective longitudinal surfaces from the first side edge to the second side edge. The first outflow passage is structured so that the gas produces a specific combustion.

12 Claims, 16 Drawing Sheets

(56) References Cited

U.S. PATENT DOCUMENTS

| | | | | | |
|---|---|---|---|---|---|
| 3,777,985 | A * | 12/1973 | Hughes | F24H 1/12 | 239/555 |
| 4,044,636 | A * | 8/1977 | Kolodziej | B21D 11/06 | 76/104.1 |
| 5,165,887 | A * | 11/1992 | Ahmady | F23D 14/16 | 126/92 AC |
| 7,083,123 | B2 * | 8/2006 | Molla | F23D 14/06 | 239/267 |
| 7,101,174 | B2 * | 9/2006 | Tomiura | F23D 14/06 | 431/349 |
| 2002/0001786 | A1 * | 1/2002 | Haynes | F23D 14/06 | 431/278 |
| 2003/0190573 | A1 * | 10/2003 | Keem | F23D 14/085 | 431/354 |

* cited by examiner

STOVE, FLAME PORT STRUCTURE DISPOSED IN A STOVE AND METHOD OF MAKING FLAME PORT STRUCTURE

CROSS REFERENCE TO RELATED APPLICATION

This application claims the benefit of Taiwan's Patent Application Nos. 107111984 and 107204480, filed on Apr. 3, 2018, at Taiwan's Intellectual Property Office, the disclosures of which are incorporated herein in their entirety by reference.

TECHNICAL FIELD

Embodiments in the present disclosure are related to a stove, a flame port structure and a method of making the flame port structure, and more particularly to a flame port structure for a gas to produce a specific combustion and a method of making the flame structure.

BACKGROUND

Please refer to FIG. 1 and FIG. 2. FIG. 1 is a schematic diagram showing a flame stove 1 with an inner flame design. FIG. 2 is a schematic diagram showing a sectional view of the flame stove 1 with the inner flame design. As shown in FIGS. 1 and 2, the stove 1 is basically formed by combining a base 10 with an upper cover 12. The upper cover 12 serves as a material supply cover 12, and is coupled to the base 10. An upper portion of the stove 1 includes a stove outlet 120; the stove 1 is configured to have a flame port collection 11 below the stove outlet 120, i.e., the stove 1 includes a plurality of flame ports 110. The material supply cover 12 serves as a sleeve, and is disposed on the outside of the flame collection 11 and above it, i.e., outside a first side edge 110*a* of the flame collection 11. The flame collection 11 further includes a second side edge 110*b*. The stove 1 further includes a partition plate 100 below the flame collection 11, wherein the partition plate 100 is used to separate the second side edge 110*b* from a feed space 103 of the base 10. The feed space 103 has a gas pathway 104. The gas GA enters the feed space 103 from the gas pathway 104, is distributed as evenly as possible through a first shunt hole 103*a*' of a first shunt board 103*a* and a second shunt hole 103*b*' of a second shunt board 103*b*, then flows from the first side edge 110*a* to the second side edge 110*b* to reach the flame port 110, and is burnt at the flame port 110. The partition plate 100 is coupled to the base 10. The flame port collection 11 is coupled to the material supply cover 12 and the partition plate 100. The base 10 is coupled to the first shunt board 103*a* and the second shunt board 103*b*. If the stove 1 is used to cook, the partition plate 100 has a drain opening 102 to facilitate discharge of liquid from the partition plate 100. In addition, the stove 1 further includes an igniter 101 in general.

Please refer to FIG. 3, which is a schematic diagram showing a manufacturing process of a flame port structure in the prior art. It can be seen from the illustration in FIGS. 1 and 2 that, in order to achieve a distribution of the plurality of flame port 110 in the material supply cover 12, the most intuitive method for forming the plurality of flame port 110 is to use the annular plate CR as shown in FIG. 3, wherein the distribution should be dense and broad. By stamping on the mother sheet P, the annular sheet CR is punched out. After punching or at the same time of punching, concave-convex patterns are formed on the annular sheet CR by giving a press, and the flame port 110 is formed by aligning one convex pattern to another convex pattern of two adjacent annular sheets CR and by aligning one concave pattern to another concave pattern of the two adjacent annular sheets CR. However, such a process will generate the first scrap P' and the second scrap P", which is a waste of material. Even though the scrap can be reused through a good design, the stamped material is usually slightly distorted and has raw edges. It is not so easy to use it again, and it can be seen that the waste of material is a major drawback of the conventional technology. Furthermore, because it is made by stamping, the size of the stamping die is fixed, and if you want to make different sizes of circular sheets CR depending on the size of the stamping dies, the cost of the dies would be very high if they were to handle a variety of small-scale productions. In other words, the different size of the stoves that the manufacturer could provide were too few to be tailored to individual customers, and therefore less flexibility is another result of the shortcoming of the conventional technology.

Because of the various disadvantages of the prior art, the Applicant has invented the present application entitled "a stove, a flame port structure and a method of making the flame port structure". Firstly, the cost of materials is greatly reduced, and secondly, agility and flexibility in production are greatly increased to make it possible to improve the lack of the above-mentioned prior-art means.

SUMMARY OF EXEMPLARY EMBODIMENTS

The purpose of the present application is to provide a stove and a flame port structure disposed in the stove, wherein the stove can save more material, and have more agility and flexibility in making production. A flame port is formed by bending a strip of sheet material into an annular strip and forming an undulating structure thereon. Since a long sheet of material is directly bent, each position on the long strip of sheet material is utilized, and the large area of waste generated by conventional techniques as shown in FIG. 3 is no longer present. In addition, if the diameter of the annular strip has been determined, the length of the long strip material can be determined based on the diameter. Furthermore, the elongated strip is bent into a ring shape, and further wound into a spiral shape to have a plurality of annular segments; and then the adjacent annular segments are joined. That is, only one long strip material is needed to form the flame collection with an appearance similar to that of FIGS. 1 and 2. In addition, the set of flame port collection of the present invention is a continuous spiral strip, rather than a stack of a plurality of individual annular segments. It can be seen that the invention greatly saves the amount of necessary material.

In accordance with one embodiment of the present disclosure, a flame port structure for burning a gas is disclosed. The flame port structure for burning a gas is a first continuous spiral strip, and a second continuous spiral strip. The first continuous spiral strip has a first side edge, a second side edge and a first plurality of annular segments. The second continuous spiral strip has a third side edge, a fourth side edge and a second plurality of annular segments. Each of the first plurality of annular segments and each of the second plurality of annular segments respectively have two first longitudinal opposite surfaces and two second longitudinal opposite surfaces. A first outflow passage has a first defining wall formed on each of the first respective longitudinal surfaces from the first side edge to the second side edge. A second outflow passage has a second defining wall formed on each of the second respective longitudinal surfaces from the third side edge to the fourth side edge. The first and second outflow passages are structured so that the gas produces a specific combustion In accordance with one embodiment of the present disclosure, a flame port structure for burning a gas is disclosed. The flame port structure for burning a gas includes a first continuous spiral strip. The first continuous spiral strip has a first side edge, a second side edge and a first plurality of annular segments. Each of the first plurality of annular segments has two first longitudinal opposite surfaces. A first outflow passage has a defining wall formed on each of the first longitudinal surfaces from the first side edge to the second side edge. The first outflow passage is structured so that the gas produces a specific combustion.

In accordance with a further embodiment of the present disclosure, a method of making a flame port structure for burning a gas is disclosed. The method of making a flame port structure for burning a gas includes steps of providing a first elongate strip having a first transverse direction, two first longitudinal surfaces, a first side edge and a second side edge; and spirally winding the first elongate strip in the first transverse direction according to a first specific curvature to form a first plurality of annular segments.

The above embodiments and advantages of the present invention will become more readily apparent to those ordinarily skilled in the art after reviewing the following detailed descriptions and accompanying drawings.

DETAILED DESCRIPTION OF THE PREFERRED EMBODIMENTS

Please refer to all FIGS. of the present invention when reading the following detailed description, wherein all FIGS. of the present invention demonstrate different embodiments of the present invention by showing examples, and help the skilled person in the art to understand how to implement the present invention. However, the practical arrangements and the present method provided to implement the present invention is not necessary to completely comply with the descriptions in the specification. The present examples provide sufficient embodiments to demonstrate the spirit of the present invention, each embodiment does not conflict with the others, and new embodiments can be implemented through an arbitrary combination thereof, i.e., the present invention is not restricted to the embodiments disclosed in the present specification.

Figure 1:
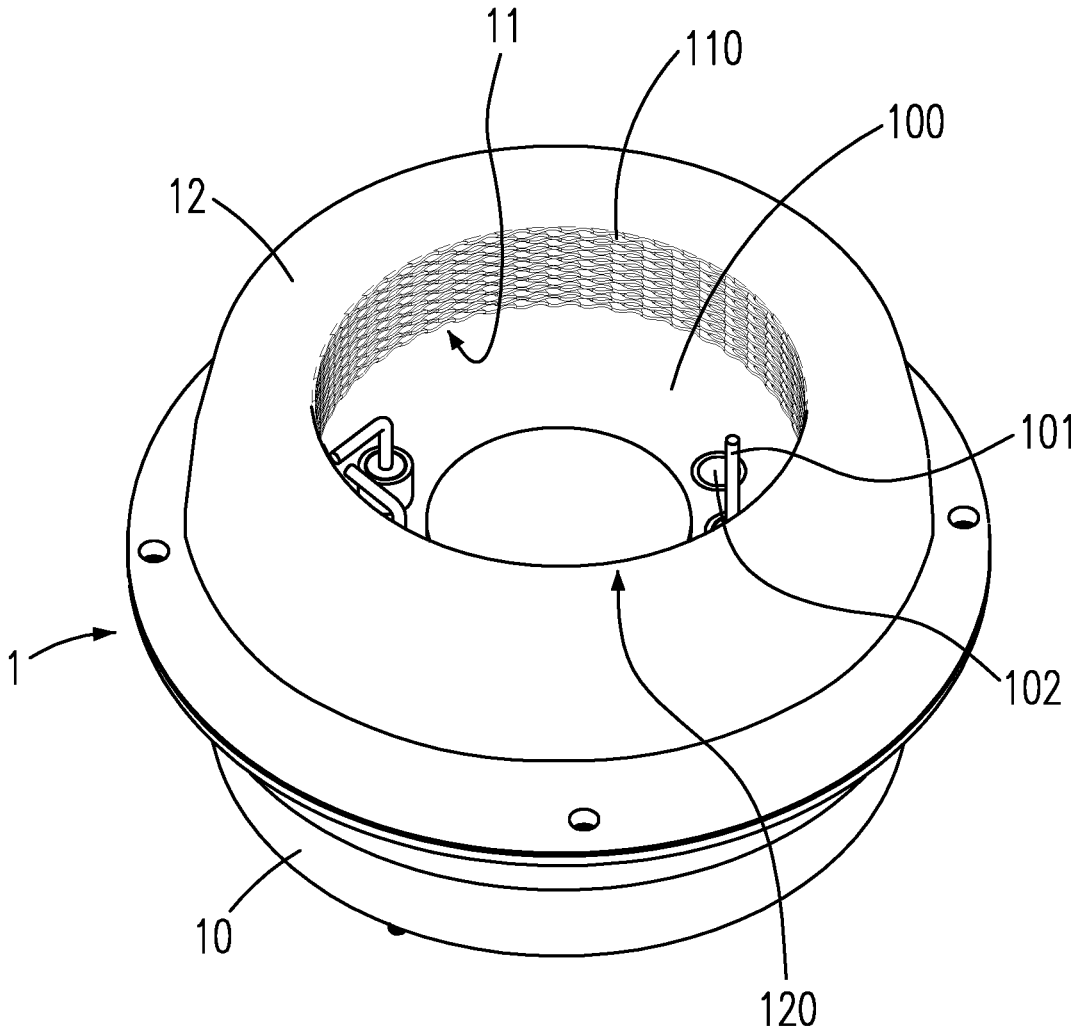
FIG. 1 is a schematic diagram showing a flame stove with an inner flame design.
Figure 2:
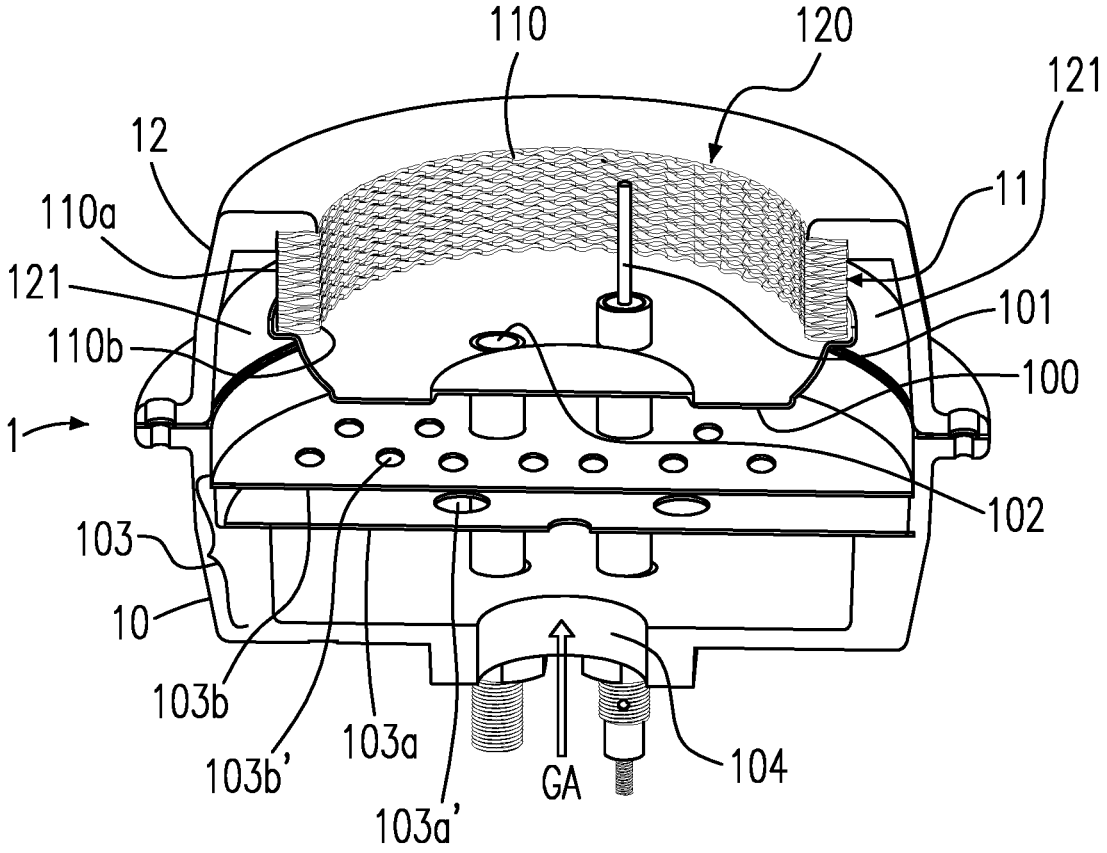
FIG. 2 is a schematic diagram showing a sectional drawing of the flame stove with the inner flame design.
Figure 4:
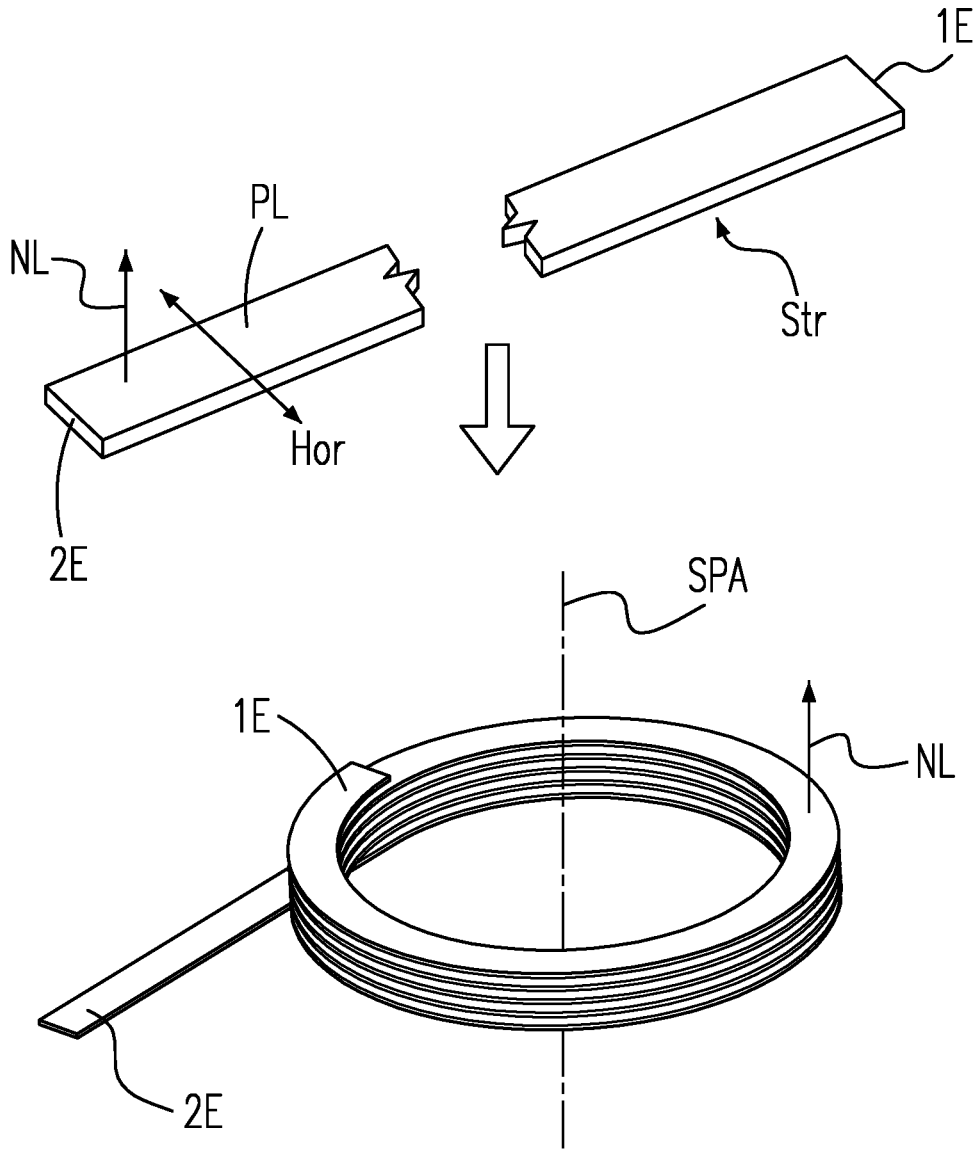
FIG. 4 is a schematic diagram showing a manufacturing process of a flame port structure according to the preferred embodiment of the present disclosure.

Please refer to FIG. 4, which is a schematic diagram showing a manufacturing process of a flame port structure according to the preferred embodiment of the present disclosure. Please review together with FIGS. 1 and 2. FIG. 4 shows a long strip Str, i.e., a sheet strip Str, having a first end 1E and a second end 2E, and a plane PL (surface). The plane PL has a normal line NL, and its short-width edge has a transverse direction Hor. In the manufacturing step, firstly, a sheet strip Str is provided; the sheet strip Str is bent along a side direction of the plane PL of the sheet strip Str, that is, the transverse direction Hor; and a heaving structure is formed on the sheet strip. In general, when bending is made, there will be a reference axis as the winding axis SPA according to the bending, and the winding axis SPA of the present case is parallel to the normal line NL of the plane PL. Under a condition that the winding radius is not changed and the winding is performed according to the winding axis SPA, a continuous spiral strip as shown in the lower part of FIG. 4 is generated. From this, it can be seen that almost no material on any part of the sheet strip Str is wasted after the sheet strip Str being a raw material is spirally wound. In addition, it can be seen that the first end 1E is located above the continuous spiral strip, and the second end 2E is located at the lower side thereof. After the winding process or when the manufacturing process, a heaving structure is formed on the sheet strip Str to form the flame port collection 11 as shown in FIGS. 1 and 2. However, the flame port collection 11 of the present invention also has the first end 1E and the second end 2E, and it will be explained in more detail later.

Figure 5:
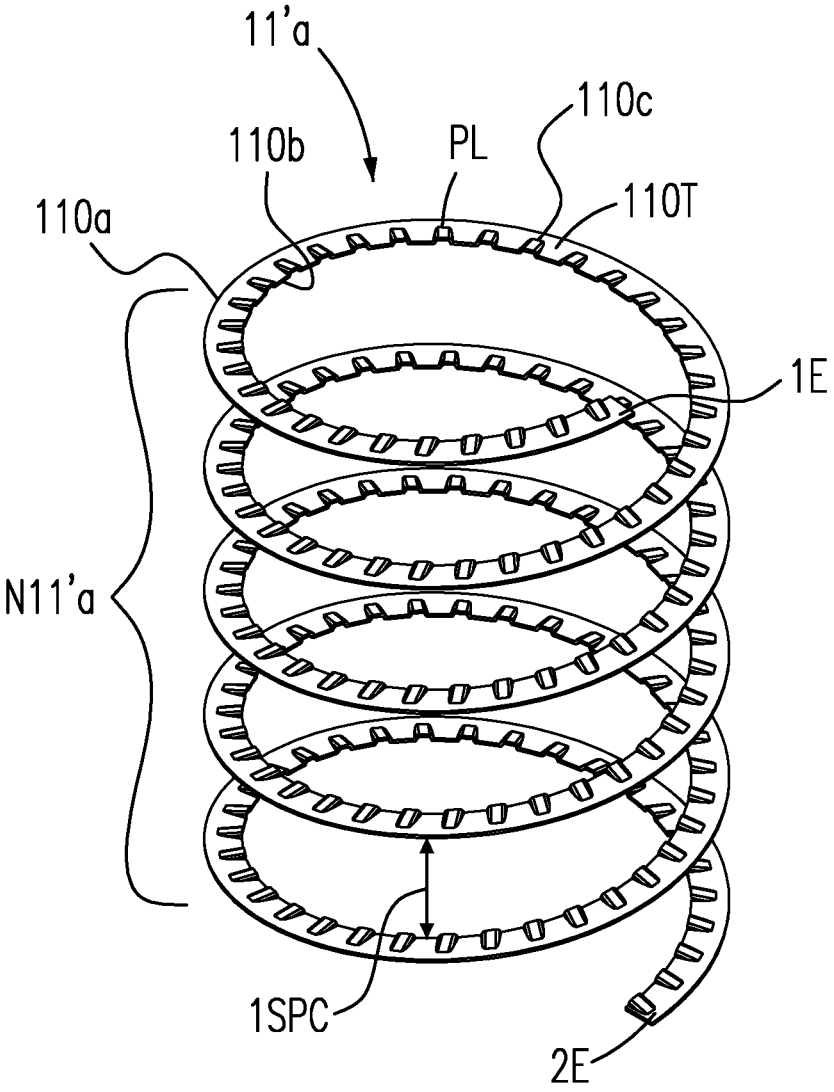
FIG. 5 is a schematic diagram showing a continuous spiral strip having a heaving surface according to the preferred embodiment of the present disclosure.
Figure 6:
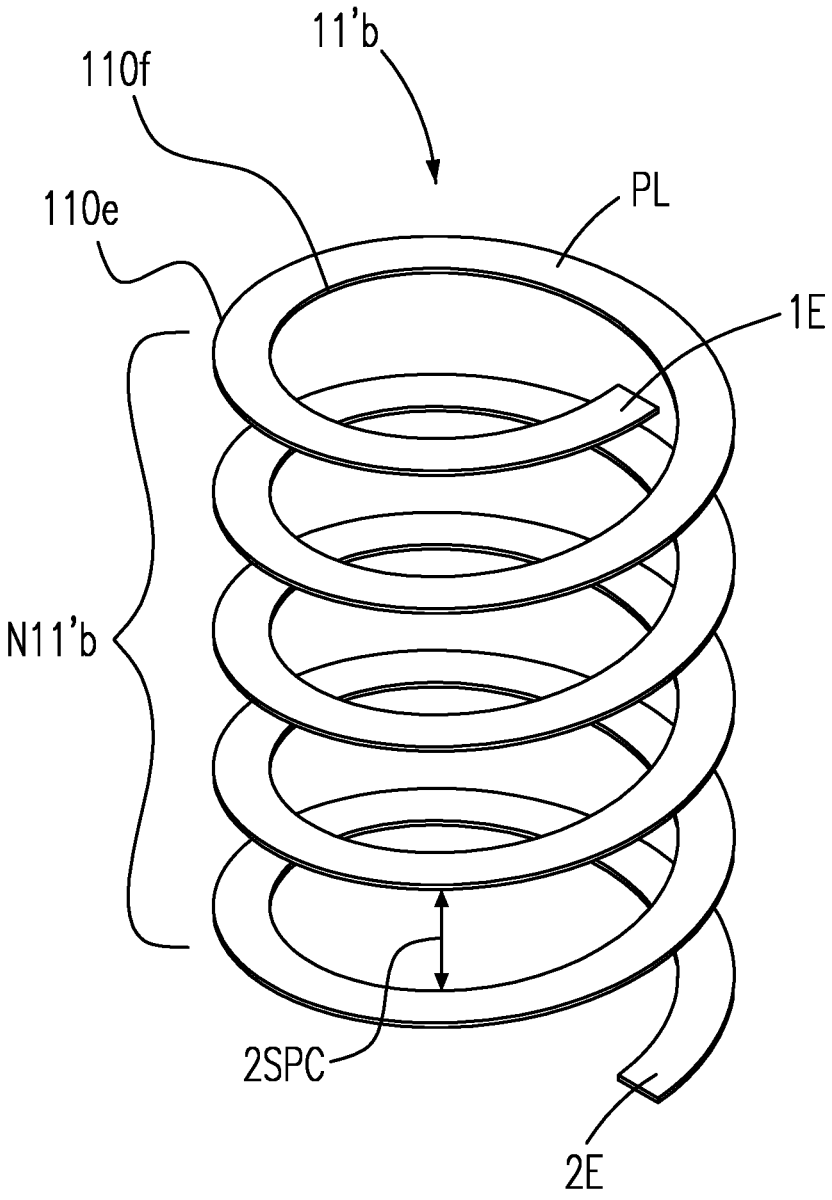
FIG. 6 is a schematic diagram showing a continuous spiral strip with a planar shape according to the preferred embodiment of the present disclosure.
Figure 7:
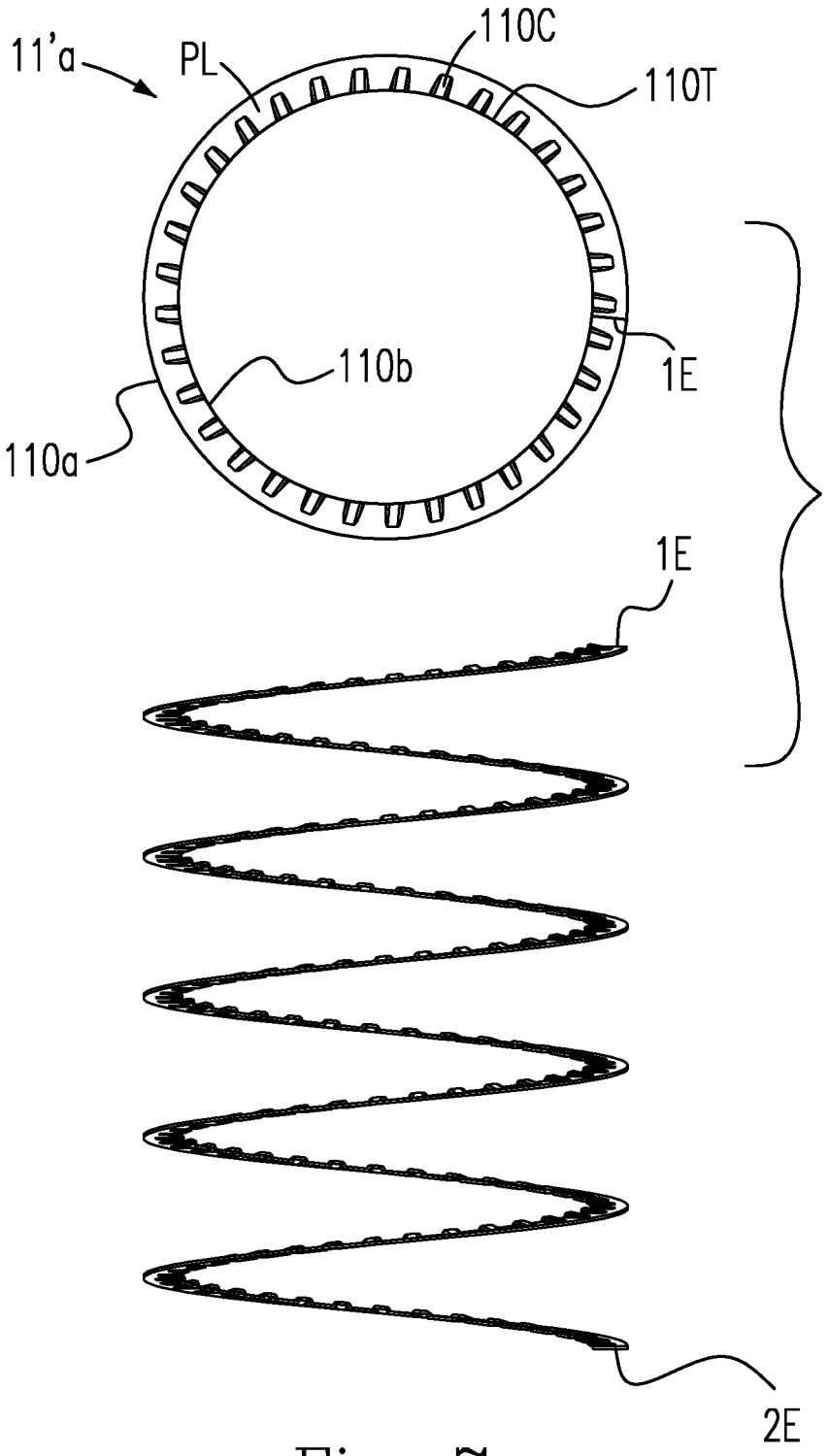
FIG. 7 shows a side view and a top view of the continuous spiral strip shown in FIG. 5.

Please refer to FIG. 5, FIG. 6 and FIG. 7. FIG. 5 is a schematic diagram showing a continuous spiral strip having a heaving surface according to the preferred embodiment of the present disclosure. FIG. 6 is a schematic diagram showing a continuous spiral strip with a planar shape according to the preferred embodiment of the present disclosure. FIG. 7 shows a side view and a top view of the continuous spiral strip shown in FIG. 5. FIG. 5 shows a first continuous spiral strip 11'*a* having a heaving structure thereon, i.e., a designed curved surface, including at least one of a convex portion 110C and a concave portion 110T. The convex portion 110C and the concave portion 110T have a relative structure; that is, both sides of the convex portion 110C are relatively low, so they are sunken; that is, both sides of the convex portion 110C are the concave portions 110T. Similarly, for the concave portion 110T, both sides of the concave portion 110T are relatively high, and are therefore prominent; i.e., both sides of the concave portion 110T are the convex portions 110C. The step of winding sheet strip and the step of forming the designed curved surface may be completed separately or simultaneously; or firstly the designed curved surface may be formed on the sheet strip Str (FIG. 4), and then the sheet strip Str may be spirally wound. The first continuous spiral strip 11'*a* has a first plurality of annular segments N11'*a*. In fact, as shown in FIGS. 4 and 5, the sheet strip Str is wound with a plurality of turns, i.e., has a plurality of turns, and each segment therebetween has a first gap 1SPC. The first continuous spiral strip 11'*a* shown in FIG. 5 still has a plane PL, a first side edge 110*a*, and a second side edge 110*b*. Moreover, since the first continuous spiral strip 11'*a* is a spiral object formed by a long plate-shaped body (please refer to the sheet strip Str in FIG. 4), it still has a first end 1E and a second end 2E.

Please refer to FIG. 6, which shows a second continuous spiral strip 11'*b*. The second continuous spiral strip 11'*b* does not have an undulating structure, and therefore is a planar continuous spiral strip. The second continuous spiral strip 11'*b* has a second plurality of annular segments N11'*b*. In fact, as shown in FIGS. 4 and 6, the sheet strip Str is wound with a plurality of turns, i.e., has a plurality of turns, and each segment therebetween has a second gap 2SPC. The second continuous spiral strip 11'*b* shown in FIG. 6 still has a plane PL, a third side edge 110*e* (corresponding to the position of the first side edge 110*a*), and a fourth side edge 110*f* (corresponding to the position of the second side edge 110*b*). Moreover, since the second continuous spiral strip 11'*b* is a spiral-shaped object formed by a long plate-shaped body (please refer to the sheet strip Str in FIG. 4), it still has a first end 1E and a second end 2E.

In addition, the second continuous spiral strip 11'*b* without a designed curved surface in FIG. 6 may also be regarded as a semi-finished product of the first continuous spiral strip 11'*a*; this means that the sheet strip Str is firstly wound into a second continuous spiral strip 11'*b*, and then the continuous spiral strip 11'*b* is further machined into a designed curved surface to become a finished product of the first continuous spiral strip 11'*a*. The size, the shape, and the amplitude of the undulating structure of the designed surface can also be changed over time. Please refer to FIG. 7, which shows a side view and a top view of the first continuous spiral strip 11'*a*. The upper side in FIG. 7 shows the top view of the first continuous spiral strip 11'*a*, which has a plane PL, a convex portion 110C, a concave portion 110T, a first side edge 110*a*, a second side edge 110*b*, and a first end 1E. On the other hand, the lower side in FIG. 7 shows a side view of the first continuous spiral strip 11'*a*, which has the first end 1E and the second end 2E. The top and side views of the second continuous spiral strip 11'*b* are substantially the same as those shown in FIG. 7, except that the second continuous spiral strip 11'*b* is planar, so that there is no convex portion 110C or concave portion 110T.

Figure 8:
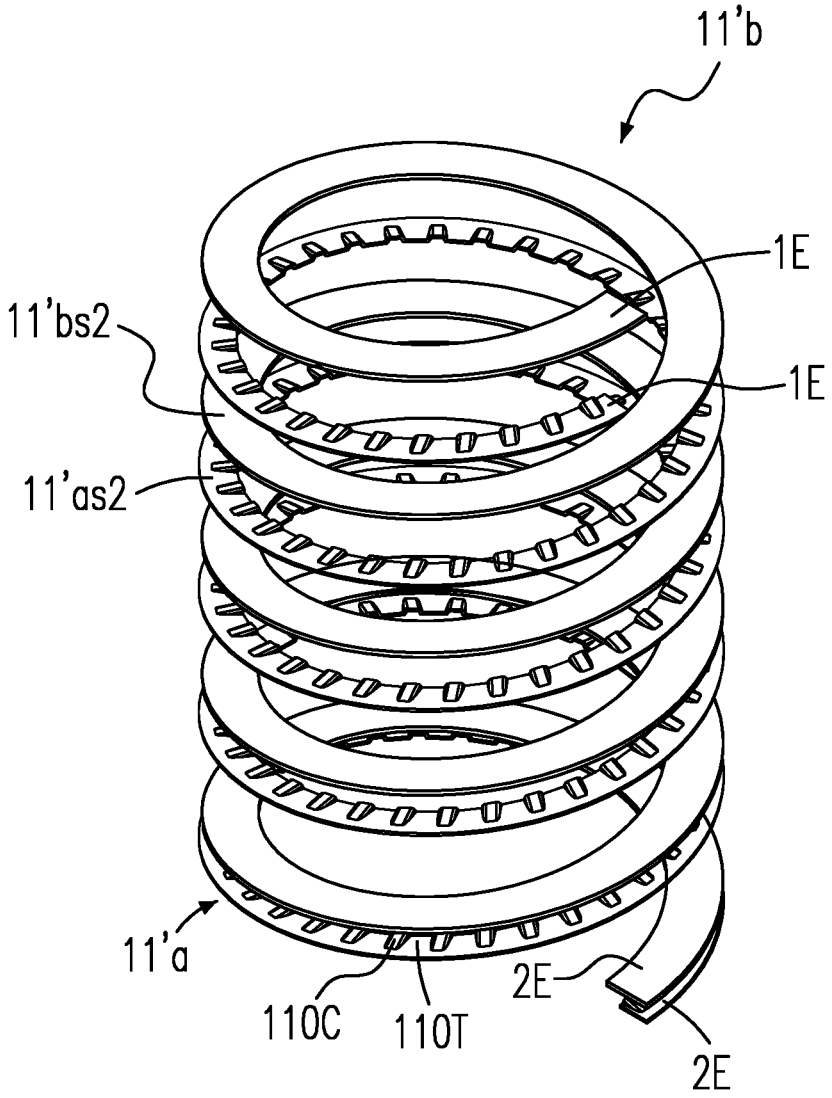
FIG. 8 is a schematic combination diagram of the continuous spiral strips shown in FIGS. 5 and 6 according to the preferred embodiment of the present disclosure.

Please refer to FIG. 8, which is a schematic combination diagram of the continuous spiral strips shown in FIGS. 5 and 6 according to the preferred embodiment of the present disclosure. Due to the design reason considered for the convex portion 110C and the concave portion 110T on the plurality of annular segments N11'*a* of the first continuous spiral strip 11'*a*, it is likely that the convex portions 110C of two adjacent annular segments N11'*a* and N11'*b* are exactly corresponding to each other. This means that the convex portion 110C (concave portion 110T) of a certain segment exactly corresponds to the back of the convex portion 110C (concave portion 110T) of the other segment, so that there will be no fluid passage between the two, and the flame port 110 (referring to FIGS. 1 and 2) will not be generated when two adjacent annular segments N11'*a*, N11'*b* are combined. Therefore, in order to avoid this phenomenon, in the present invention the second continuous spiral strip 11'*b* is screwed into the first gap 1SPC of the first continuous spiral strip 11'*a*. In contrast, the first continuous spiral strip 11'*a* is screwed into the second space 2SPC of the second continuous spiral strip 11'*b*. It can be seen in FIG. 8 that the first end 1E of the first continuous spiral strip 11'*a* and the first end 1E of the second continuous spiral strip 11'*b* are very close, and so are the second end 2E of the first continuous spiral strip 11'*a* and the second end 2E of the second continuous spiral strip 11'*b*. Of course, the relative positions of the two continuous spiral strips 11'*a* and 11'*b* can be changed for practical needs. The convex portion 110C and the concave portion 110T are just above the second continuous spiral strip 11'*b*. The first continuous spiral strip 11'*a* is coupled to the second continuous spiral strip 11'*b*. The actual combination of the two continuous spiral strips 11'*a* and 11'*b* is illustrated in FIG. 9.

Figure 9A:
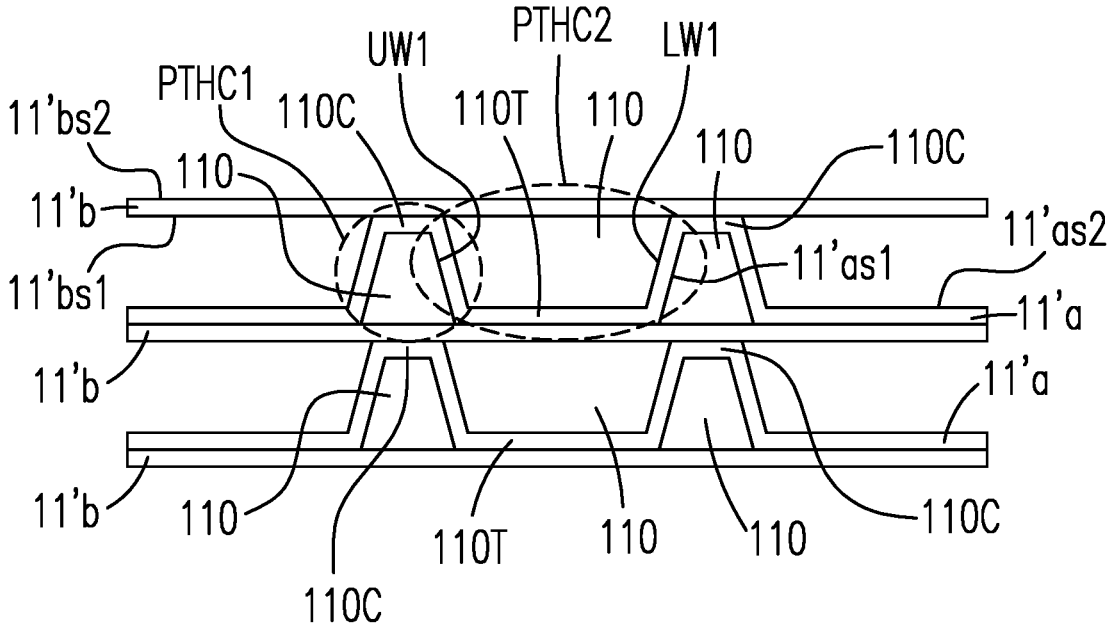
FIG. 9A is a schematic diagram of the completed assembly shown in FIG. 8.

Please refer to FIG. 9A, which is a schematic diagram of the completed assembly shown in FIG. 8. In order to simplify the drawing, in FIG. 9A, the originally circular ring-shaped segment is illustrated in a straightened form and is viewed sideways. It can be seen that a first continuous spiral strip 11'*a* can be arranged between every two second spiral strips 11'*b*; that is, the second continuous spiral strip 11'*b* is located at the first space 1SPC of the first continuous spiral strip 11'*a* (referring to FIG. 8), wherein each convex portion 110C has a second continuous spiral strip 11'*b* underneath, so that a flame port structure 110 is formed therebetween. Similarly, there is a second continuous spiral strip 11'*b* above each concave portion 110T, so that a flame port structure 110 is formed therebetween. The portion within the flame structure 110 and between the first side edge 110*a* and the second side edge 110*b* is a gas flow path.

Figure 10A:
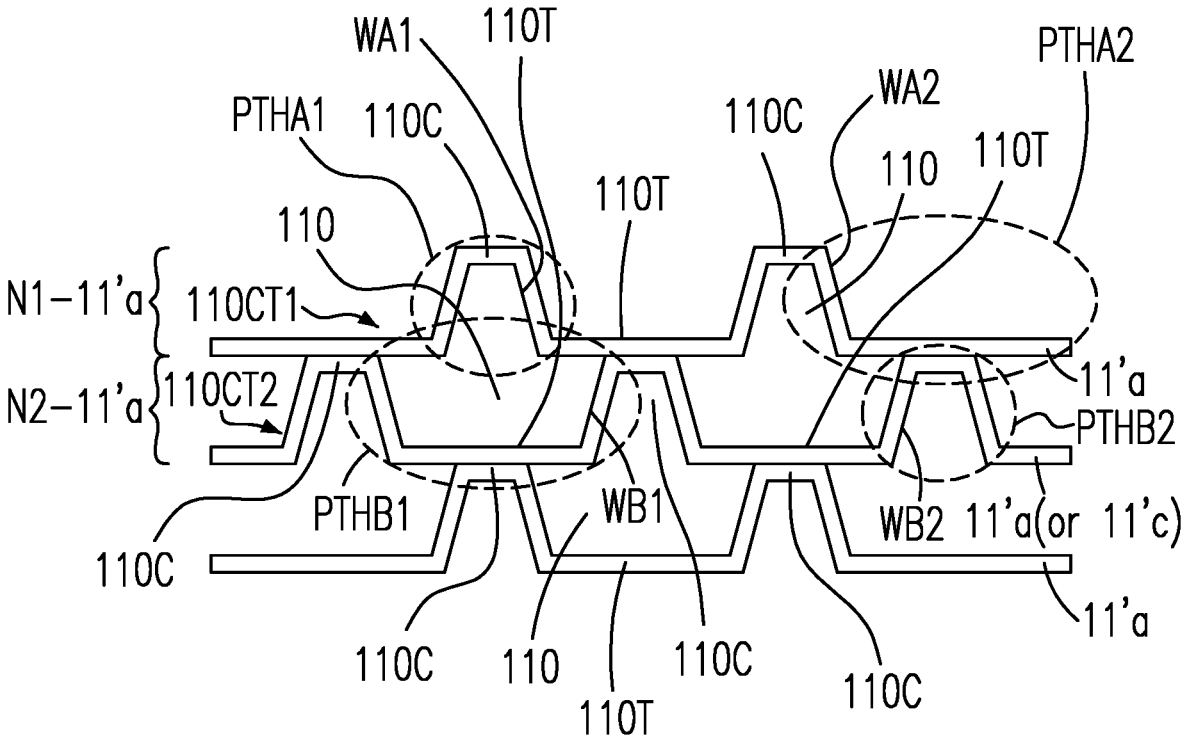
FIG. 10A is a schematic diagram of a complete assembly using a single material shown in FIG. 5 alone.

Please refer to FIG. 10A, which is a schematic diagram showing the complete assembly using a single material shown in FIG. 5 alone. As shown in FIG. 10A, the flame port structure 110 is formed directly by using the first continuous spiral strip 11'*a* shown in FIG. 5. By setting the circumferential distance formed by each convex portion 110C therebetween and each concave portion 110T therebetween, or setting the circumferential length, that is, the winding diameter, it is possible to make the position of the convex portion 110C of the annular segments N11'*a* of any adjacent two first continuous spiral strip 11'*a* (or 11'*a* and 11'*c* shown in FIG. 10A) to be interleaved toward the axis direction SPA. As a result, the convex portions 110C are combined with the concave portion 110T of the adjacent annular segments N11'*a* and N11'*b*, so that the flame port structure 110 is formed. In addition, FIG. 10A also discloses a flame port structure 110 assembled by using two or more first continuous spiral strips 11'*a* shown in FIG. 5. By adjustment of the angle during assembly, the convex portion 110C on the annular segments N11'*a* of the two adjacent first continuous spiral strips 11'*a* are interleaved at positions toward the axis direction SPA (shown in FIG. 4). That is to say, the convex portion 110C on the first annular segment N1-11'*a* of the first continuous spiral strip 11'*a* and the convex portion 110C on the second annular segment N2-11'*a* of the second first continuous spiral strip 11'*a* are interleaved at the position toward the axis direction SPA, so that the convex portion 110C of the first continuous spiral strip 11'*a* corresponds to the concave portion 110T of the second continuous spiral strip 11'*a*, and therefore the flame port structure 110 is further formed.

Figure 9B:
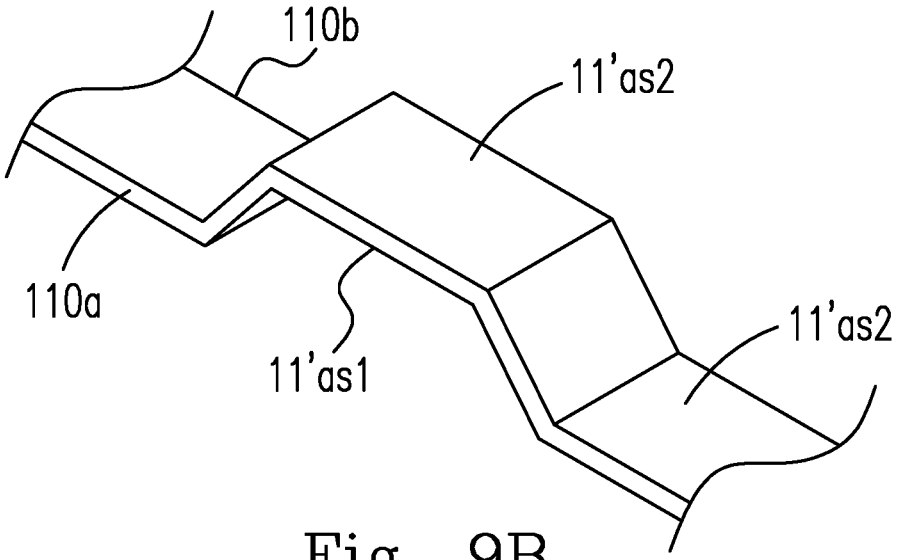
FIG. 9B is a schematic 3D view diagram of a convex portion.
Figure 10B:
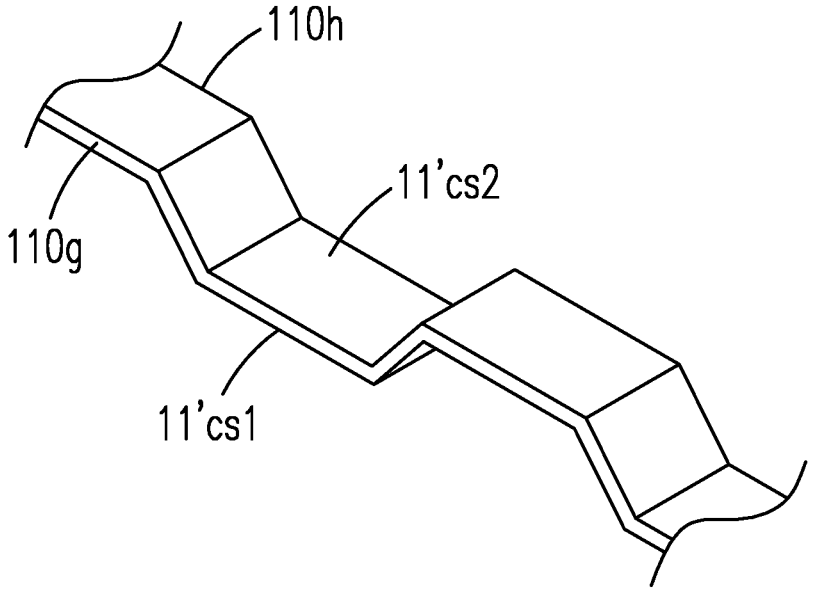
FIG. 10B is a schematic 3D view diagram of a concave portion.

Please refer to FIGS. 9B and 10B, which are schematic 3D views of the convex portion 110C and the concave portion 110T respectively according to the preferred embodiment of the present disclosure. Please also refer to FIGS. 1, 2, 4, 5, 6, 7, 8, 9A and 10A, the flame port structure 110 for burning a gas GA includes a first continuous spiral strip 11'*a*, a second continuous spiral strip 11'*b*, a first outflow passage PTHA1 and PATHA2, and a second outflow passage PTHB1 and PTHB2. The first continuous spiral strip 11'*a* has a first side edge 110*a*, a second side edge 110*b* and a first plurality of annular segments N11'*a*. The second continuous spiral strip 11'*b* has a third side edge 110*g*, a fourth side edge 110*h* and a second plurality of annular segments N11'*b*. Each of the first plurality of annular segments N11'*a* and each of the second plurality of annular segments N11'*b* respectively have two first longitudinal opposite surfaces 11'*as*1, 11'*as*2 and two second longitudinal opposite surfaces 11'*bs*1, 11'*bs*2 as shown in FIGS. 8 and 9. The first outflow passage PTHA1 and PATHA2 has a first defining wall WA1, WA2 formed on each of the first respective longitudinal surfaces 11'*as*1, 11'*as*2 from the first side edge 110*a* to the second side edge 110*b*. The second outflow passage PTHB1 and PTHB2 has a second defining wall WB1, WB2 formed on each of the second respective longitudinal surfaces 11'*cs*1, 11'*cs*2 from the third side edge 110*g* to the fourth side edge 110*h*. The first and second outflow passages PTHA1, PTHA2, PTHB1 and PTHB2 are structured so that the gas GA produces a specific combustion.

In FIG. 9A, the first continuous spiral strip 11'*a* is an extruded structure. At least one of the plurality of first longitudinal surfaces 11'*as*1, 11'*as*2, . . . and the plurality of second longitudinal surfaces 11'*bs*1, 11'*bs*2, . . . is provided with a plurality of spacers (for the present instance in FIG. 9A, the first longitudinal surfaces 11'*as*1, 11'*as*2 is provided with a plurality of spacers). Each of the first longitudinal surfaces 11'*as*1, 11'*as*2, . . . is heaving. Each of the second longitudinal surfaces 11'*bs*1, 11'*bs*2, . . . is planar. Adjacent first and second longitudinal surfaces 11'*as*1, 11'*bs*2/11'*as*2, 11'*bs*1 form the upper and lower walls UW1/LW1 of a respective one of the first outflow passage PTHC1 and the second outflow passage PTHC2.

In FIG. 10A, each of the first longitudinal surfaces 11'*as*1, 11'*as*2, . . . and each of the second longitudinal surfaces 11'*cs*1, 11'*cs*2, . . . are both heaving to respectively have a first and a second convex-concave structures 110CT1 and 110CT2. The first convex-concave structure 110CT1 has a first convex portion 110C. The second convex-concave structure 110CT2 has a second concave portion 110T. When the first and second convex-concave 110CT1 and 110CT2 are vertically adjacent, the first convex portion 110C is superimposed over the second concave portion 110T to form one of the first and the second outflow passages PATHA1 and PATHB1.

Figure 11:
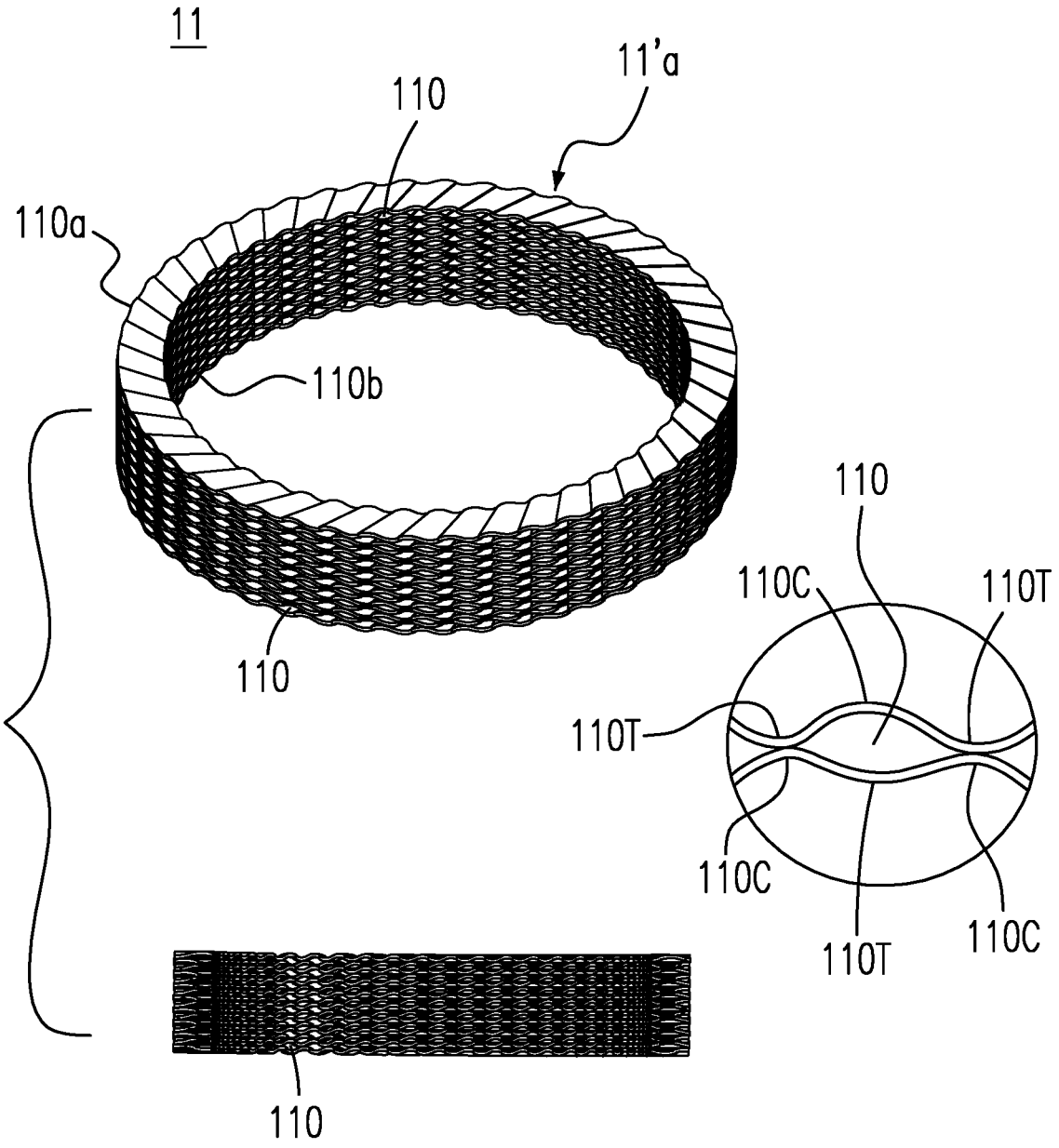
FIG. 11 is a schematic diagram of the corrugated undulation structure according to the embodiment of the present disclosure.

Please refer to FIG. 11, which is a schematic diagram of the corrugated undulation structure according to the embodiment of the present disclosure. As shown in FIG. 11, the flame port collection 11 is formed from the first continuous spiral strip 11'*a*. The undulated structure on the first continuous spiral strip 11'*a* is formed to have wave surfaces. By setting a winding diameter and each spacing between a wave peak and a wave trough, the wave peak and the wave trough of two adjacent annular segments can be in a shifted condition. As can be seen from the enlarged view, the concave portion 110T on the upper annular segment engages with the convex portion 110C on the lower annular segment, so that a flame port structure 110 is formed between the convex portion 110C on the upper annular segment and the concave portion 110T on the lower annular segment. In addition, for the sake of simplicity of the drawing, the first end 1E and the second end 2E are not shown in FIG. 11, and the first continuous spiral strip 11'*a* provided in the present disclosure for an ordinary skilled person in the technical field can be substantially formed as a structure that can correspond to the flame port collection 11 in FIG. 11.

Figure 12:
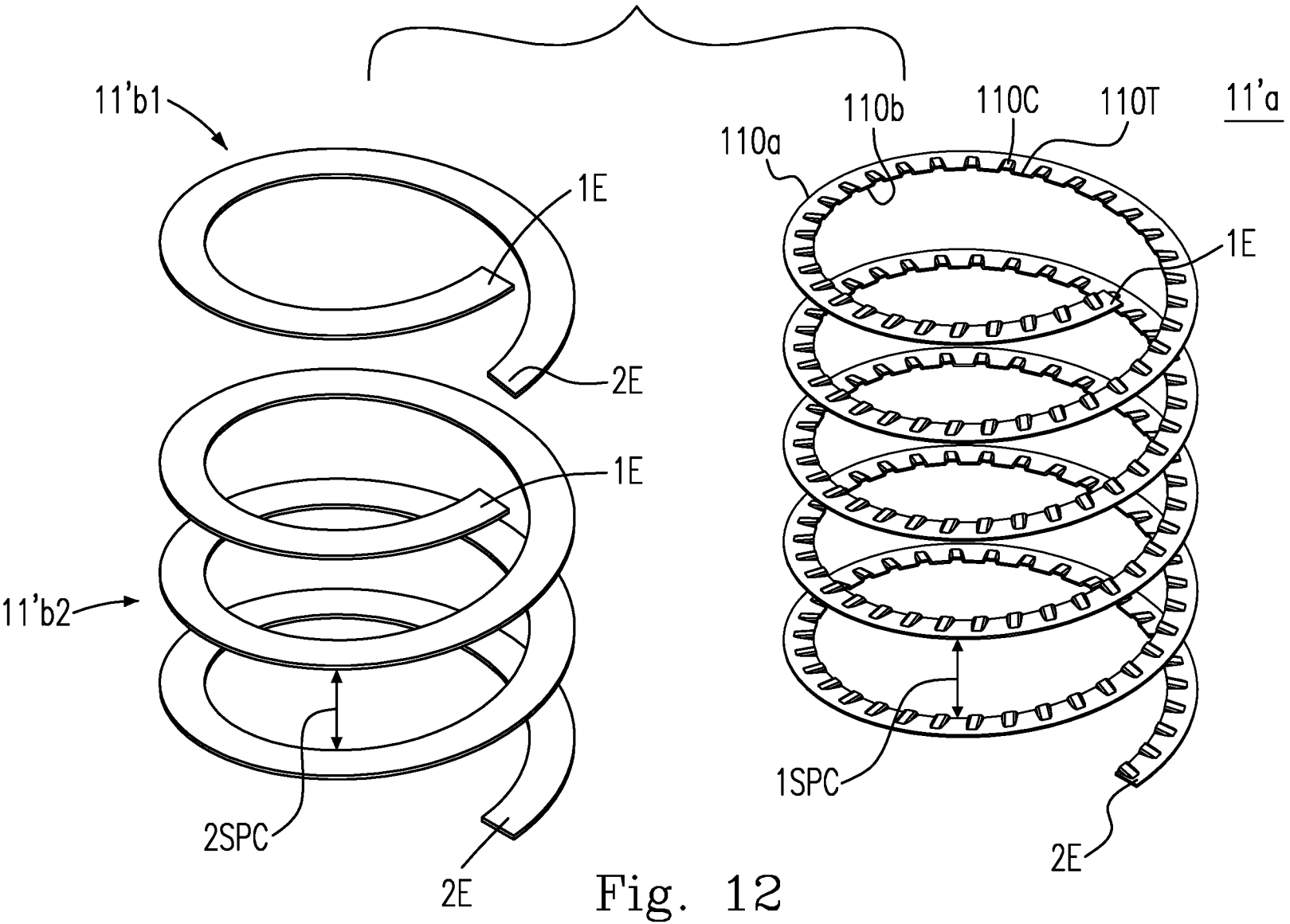
FIG. 12 is a schematic diagram showing that a plurality of planar annular segments are combined with a continuous heaving spiral strip according to the preferred embodiment of the present disclosure.

Please refer to FIG. 12, which is a schematic diagram showing a plurality of planar annular segments combined with a continuous heaving spiral strip according to the preferred embodiment of the present disclosure. A first continuous spiral strip 11'*a* is shown on the right side in FIG. 12; the descriptions thereof are similar to those relevant to FIG. 5, and will not be described in detail herein. An annular segment shown on the left side in FIG. 12, is planar, and is annotated as a second annular segment 11'*b*1 belonging to a first annular segment type, and has only one single turn. Because the second annular segment 11'*b*1 is also wound by the sheet strip Str, it also has a first end 1E and a second end 2E; and there is a gap between the two ends 1E and 2E, so that the first continuous spiral strip 11'*a* passes through the gap to have no interference. When the second annular segment 11'*b*1 is required to be combined with the first continuous spiral strip 11'*a* to form the assembly in the embodiment shown in FIG. 8, a plurality of second annular segments 11'*b*1 are required to be disposed in the first gap 1SPC. Furthermore, a second annular segment 11'*b*2 belonging to a second annular segment type is disposed below the second annular segment 11'*b*1, and has more than one winding turns, but the overall length of the second annular segment 11'*b*2 is shorter than that of the first continuous spiral strip 11'*a*, and a second gap 2SPC will also be formed in the second annular segment 11'*b*2. Therefore, when the second annular segment 11'*b*2 is required to be combined with the first continuous spiral strip 11'*a* to form the assembly in the embodiment shown in FIG. 8, a plurality of second annular segments 11'*b*2 are needed, and the second annular segment type two 11'*b*2 is disposed in the first gap 1SPC of the first continuous spiral strip 11'*a*. Similarly, the first continuous spiral strip 11'*a* is disposed within the second gap 2SPC of the second annular segment 11'*b*2. The first continuous spiral strip 11'*a* is coupled to the second annular segment 11'*b*1 and the second annular segment 11'*b*2. Of course, it is also possible that the second annular segment 11'*b*1, belonging to the first annular segment type, and the second annular segment 11'*b*2, belonging to the second annular segment type, are simultaneously used in the embodiment shown in FIG. 8.

Figure 13:
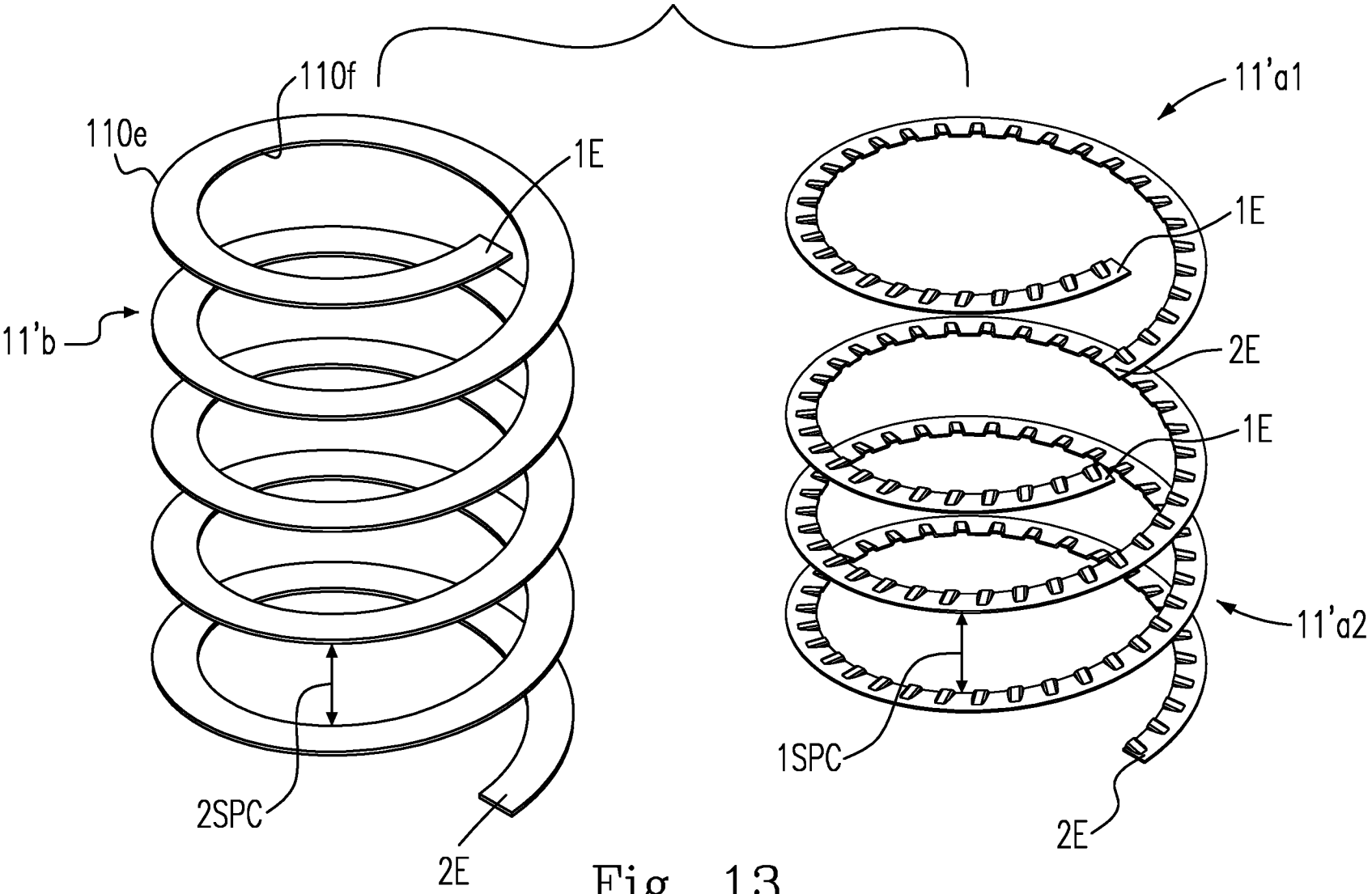
FIG. 13 is a schematic diagram showing a plurality of heaving annular segments combined with a continuous planar spiral strip according to the preferred embodiment of the present disclosure.

Please refer to FIG. 13, which is a schematic diagram showing a plurality of heaving annular segments combined with a continuous planar spiral strip according to the preferred embodiment of the present disclosure. A second continuous spiral strip 11'*b* is shown on the left side in FIG.

13; the descriptions thereof are similar to those relevant to FIG. 6, and will not be described in detail herein. An annular segment is shown on the right side in FIG. 13, has only one single turn, and is annotated as a first annular segment 11'a1 belonging to a first annular segment type. Because the first annular segment 11'a1 is also formed by winding the sheet strip Str, it also has a first end 1E and a second end 2E; and there is a gap between the two ends 1E and 2E, so that the second continuous spiral strip 11'a passes through the gap to have no interference. As for the other rest structures, because they are the same as those in FIG. 5, it will be not described in detail herein. When the first annular segment 11'a1 is required to be combined with the second continuous spiral strip 11'b to form the assembly in the embodiment as shown in FIG. 8, a plurality of first annular segments 11'a1 are required to be disposed in the second gap 2SPC. Furthermore, a first annular segment 11'a2 belonging to a second annular segment type is disposed below the first annular segment 11'a1, and has more than one winding turns, but the overall length of the first annular segment 11'a2 is smaller than that of the second continuous spiral strip 11'b, and a first gap 1SPC will also be formed in the first annular segment 11'a2. Therefore, when the first annular segment 11'a2 is required to be combined with the second continuous spiral strip 11'b to form the assembly in the embodiment as shown in FIG. 8, a plurality of first annular segments 11'a2 are needed, and the first annular segment 11'a2 is disposed in the second gap 2SPC of the second continuous spiral strip 11'b. Similarly, the second continuous spiral strip 11'b is disposed within the first gap 1SPC of the first annular segment 11'a2. The second continuous spiral strip 11'b is coupled to the first annular segment 11'a1 and the first annular segment 11'a2. Of course, it is also possible that the first annular segment 11'a1, belonging to the first annular segment type, and the first annular segment 11'a2, belonging to the second annular segment type, are simultaneously used in the embodiment as shown in FIG. 8.

Figure 14:
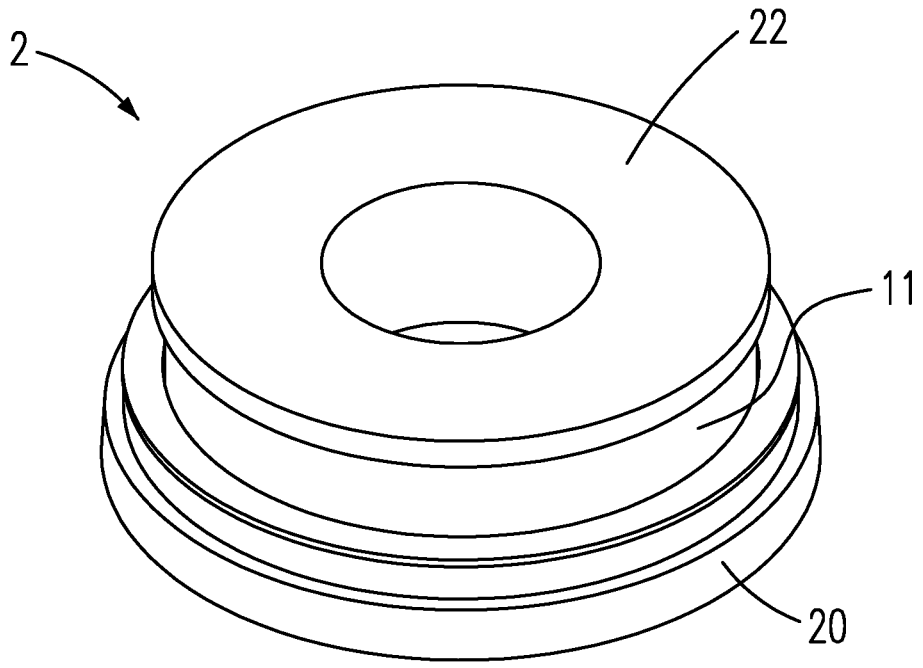
FIG. 14 is a schematic diagram of a flame stove with an outer flame design according to the preferred embodiment of the present disclosure.
Figure 15:
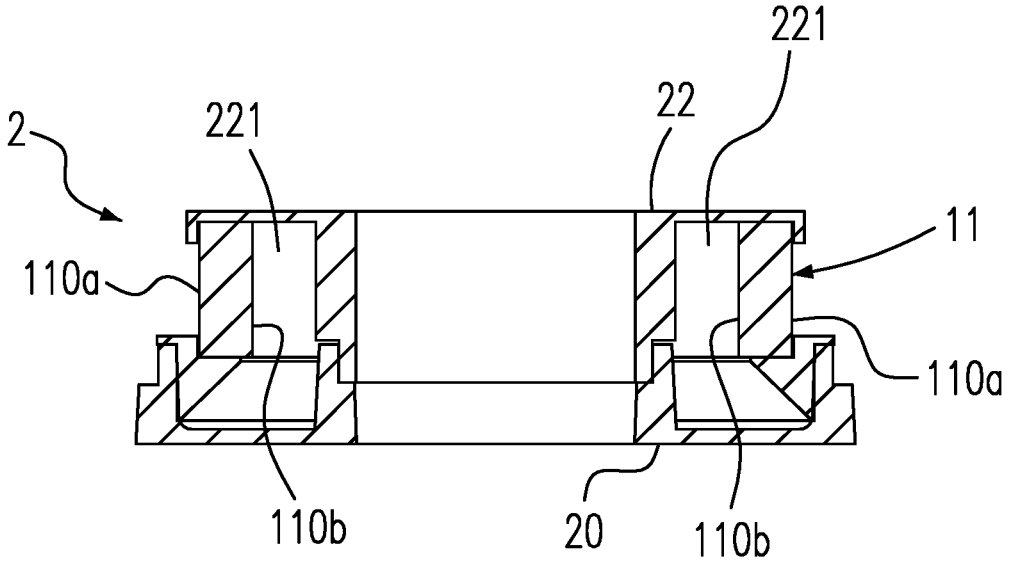
FIG. 15 is a schematic diagram of a side sectional view of the flame stove shown in FIG. 14.

Please refer to FIGS. 14 and 15. FIG. 14 shows a schematic diagram of a flame stove 2 with an outer flame design according to the preferred embodiment of the present disclosure, and FIG. 15 shows a schematic diagram of a side sectional view of the flame stove 2 shown in FIG. 14. The flame stove 2 with the outer flame design includes a base 20, a flame port collection 11 coupled to the base 20, and a feed inner cover 22 coupled to the base 20. The flame port collection 11 is disposed on the base 20. The feed inner cover 22 covers the interior and the upper portion of the flame port collection 11. The feed inner cover 22 and the flame port collection 11 has an inner material supply pathway 221 therebetween. The gas is supplied from the bottom of the base 20 to the inner material supply pathway 221, then flows from the second side edge 110b to the first side edge 110a, and burns on the first side edge 110a. Regardless of the inner flame design or the outer flame design, the gas is circulated in the fluid passage between the first side edge 110a and the second side edge 110b, and therefore the flame stove 2 can also have an embodiment structure as shown in FIGS. 5-8, 9A-9B, 10A-10B and 11-13 according to the present disclosure. When these embodiments are applied to the flame stove 2 with the outer flame design, the flame port 110 (please combine with the above figures) is formed on the first side edge 110a. In contrast, when these embodiments are applied to the flame stove 1 (please refer to FIGS. 1 and 2) with the inner flame design, a flame port 110 (please combine with the above figures) of the flame stove 1 is formed on the second side edge 110b.

Figure 16:
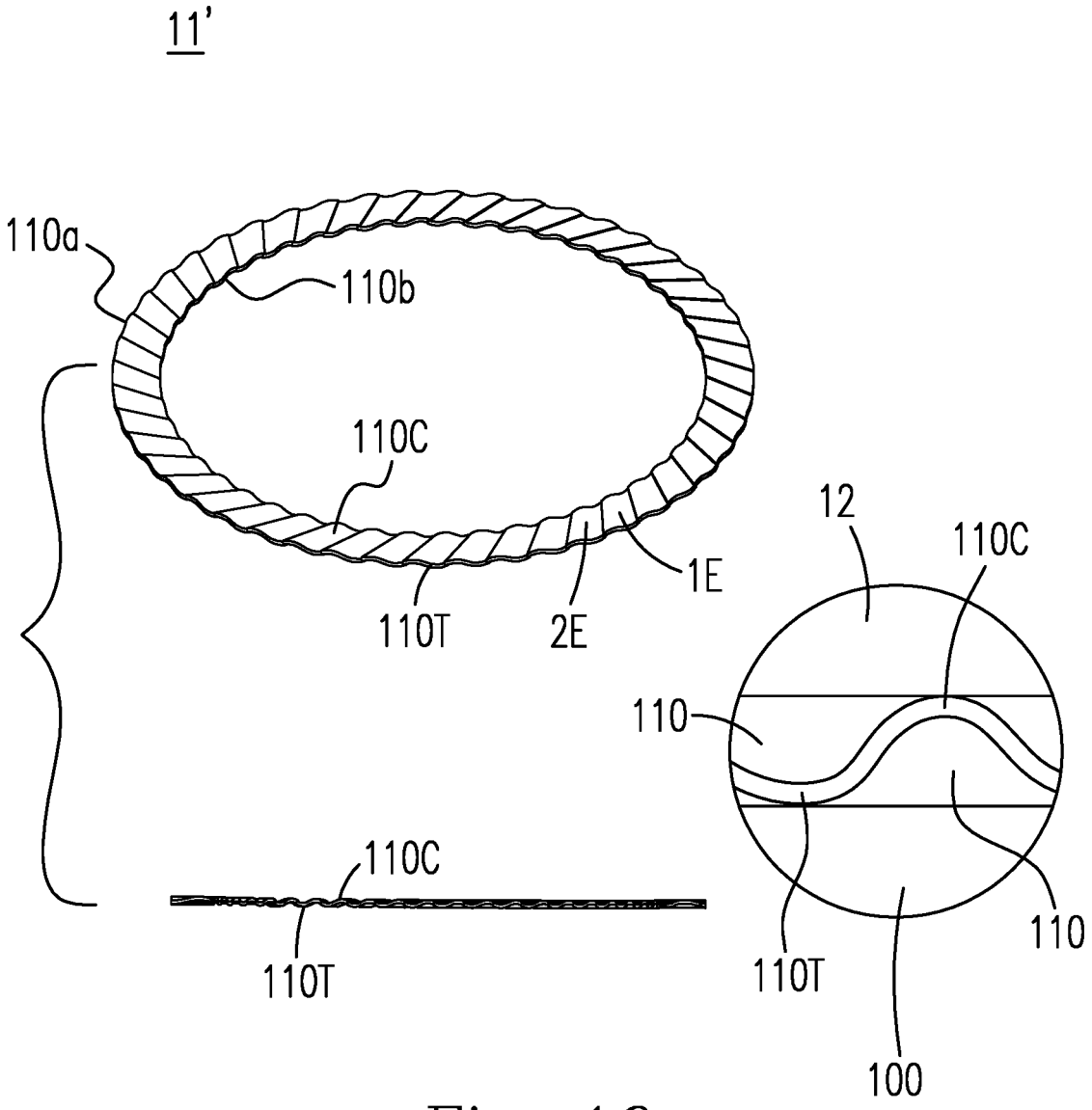
FIG. 16 is a schematic diagram of a single-turn component of the flame port according to the preferred embodiment of the present disclosure.

Please refer to FIG. 16, which is a schematic diagram showing a single-turn component of the flame port according to the preferred embodiment of the present disclosure. When the single-turn component is used in a small-size flame device, a thicker flame port collection 11 (as shown in FIG. 11) is not required, so that the sheet strip Str need only be wound in one turn to become a single ring of flame port collection 11'. The flame port collection 11' also has a convex portion 110C, a concave portion 110T, a first side edge 110a, a second side edge 110b, a first end 1E, and a second end 2E. Please also refer to FIG. 2. When the single-ring flame collection 11' is combined with the material supply cover 12 (as shown in FIG. 2) and the partition plate 100 (as shown in FIG. 2), the flame port structure 110 is formed between the convex portion 110C and the partition plate 100, and the flame port structure 110 is also formed between the concave portion 110T and the material supply cover 12. In addition, the first end 1E and the second end 2E in FIG. 16 are joined, but the first end 1E and the second end 2E may be separated according to a practical situation, such that there is a space or a gap between the two ends 1E, 2E. The single-ring flame collection 11' is coupled to the material supply cover 12 and the partition plate 100.

Figure 17:
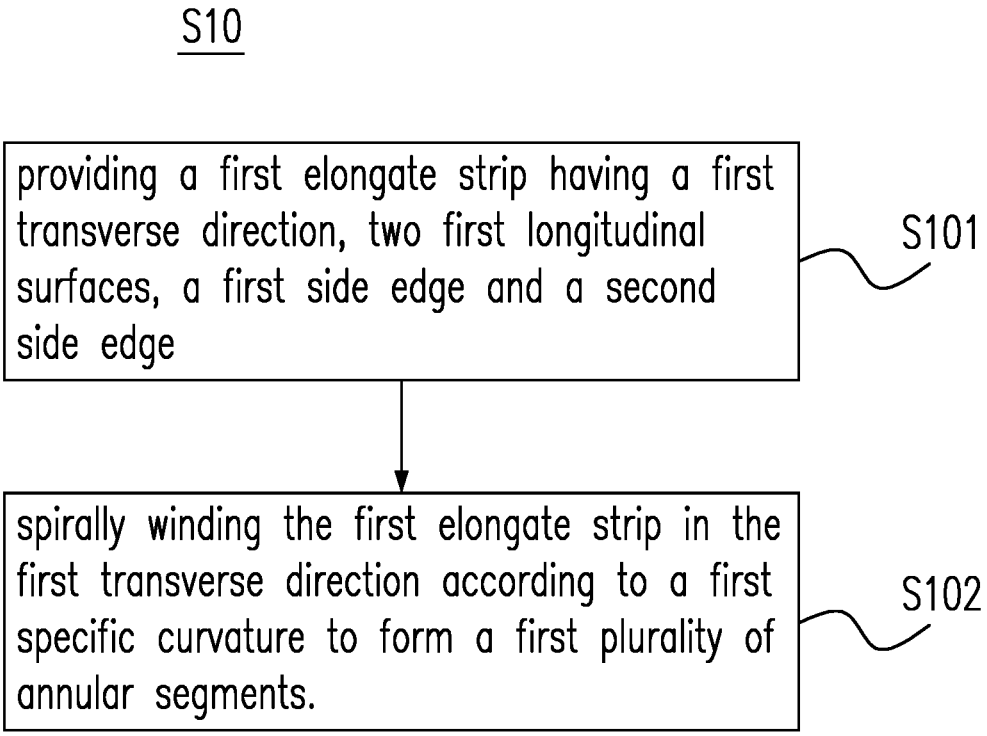
FIG. 17 is a schematic diagram of a method of making a flame port structure for burning a gas.

Please refer to FIG. 17, which is a schematic diagram showing a method S10 of making a flame port structure for burning a gas. The method S10 includes steps of: Step S101, providing a first elongate strip having a first transverse direction, two first longitudinal surfaces, a first side edge and a second side edge; and Step S102, spirally winding the first elongate strip in the first transverse direction according to a first specific curvature to form a first plurality of annular segments.

In the aforementioned embodiments of the present disclosure, under a condition that the continuous spiral strips 11'a and 11'b are combined and formed, the combination usually has a cylinder form. However, because the diameter of the winding of the present disclosure can be changed at any time, the diameter of the winding can also be gradually changed. As a result, the diameter of each annular segment becomes larger or smaller gradually, so that the combination becomes an upward-widened taper or an upward-narrowed taper. Because the upward widened taper is downward narrow and upward wide, the flame collection of the upward-widened taper is more suitable for a flame stove with an inner flame design in order to have a full combustion of the gas. Similarly, the flame port collection of the upward narrowed taper is more suitable for a flame stove with an outer flame design.

Figure 3:
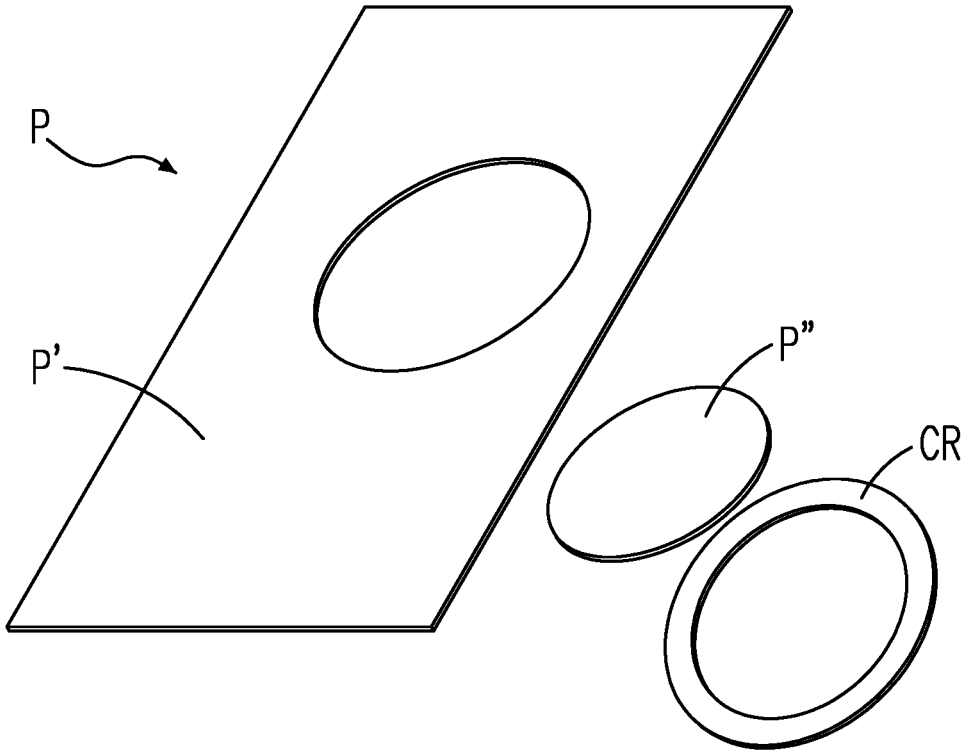
Fig. 3 (Prior Art)
FIG. 3 is a schematic diagram showing a manufacturing process of the flame port structure in the prior art.

To sum up, the purpose of "the stove and the flame port structure applied to the stove and the manufacturing method thereof" disclosed in the present invention, as described above, is to invent a stove and a flame port structure used in the stove that can save material, is more economical, frugal, and flexible in making products. Because a long strip of sheet material is directly bent into a ring-shaped strip, each location on the long sheet material can be utilized without wasting the large-area material produced by the conventional technique shown in FIG. 3. In addition, if the diameter of the annular strip has been determined, the length of the long strip can be determined based on the diameter, and the waste caused by cutting the excess portion can be further reduced.

Furthermore, the elongated strip is bent into a ring shape, and further wound into a spiral shape to have a plurality of annular segments, and then joining the adjacent annular segments, that is, a long piece of sheet material can form the flame port collection 11 to have an appearance similar to that of FIGS. 1 and 2, except that the flame port collection 11 of the present invention is in the shape of a spiral rather than a stack of a plurality of individual rings. Imagine that every conventional ring CR results in two wastes, one is the first waste P', and another is the second waste P". When there are more than a dozen rings CR, there will be the same number of first and second wastes (P', P"), this is very wasteful. On the other hand, when the present invention is used, the mother plate material P of the same area can be fully utilized, and it can be seen that the invention greatly saves the use of materials.

In addition, because the conventional technique employs the stamping process, the diameter of the ring CR determines the size of the mold and cannot be adjusted during or after the stamping process. However, because the spiral annular strip of the present invention is formed by winding, it can be adjusted at any time as long as the diameter of the winding machine with respect to the spiral is changed, the diameter of the spiral strip can be changed immediately to form a cone-shaped flame port collection or a gradual-narrow-to-wide taper or a gradual-wide-to-narrow taper, and therefore it is extremely convenient. Similarly, the design surface of the annular segment in the present invention is also made by rolling-in, and the height and width of the convexes and concaves are very easily adjusted. It is extremely easy to adapt to a variety of small-scale production, which means that it can be customized for specific customers, but the manufacturing cost will not increase. On the contrary, the traditional technology requires the use of new molds, resulting in a substantial increase in costs. The scheme of the present invention is roughly estimated to reduce more than 70% of the cost, which means that the cost of the invention is less than 30% of the traditional technology.

It can be seen that the flame port structure made by the continuous spiral strip of the present invention can greatly reduce the cost, thereby reducing the cost of the whole stoves, and reducing the selling price. It is mutually beneficial for the manufacturers and the end-users. Since the amount of waste generated according to the present invention is far less than conventional technologies, the resources consumed in waste recycling are also far less than the conventional technologies, and it is more friendly to the environment. It can be seen that the invention not only substantially improves manufacturing flexibility, significantly saves costs, also reduces the use of resources, and therefore the present invention in the technical field is a great contribution to protecting the environment.

EMBODIMENTS

1. A flame port structure for burning a gas, comprising a first continuous spiral strip having a first side edge, a second side edge and a first plurality of annular segments; and a second continuous spiral strip having a third side edge, a fourth side edge and a second plurality of annular segments, wherein each of the first plurality of annular segments and each of the second plurality of annular segments respectively have two first longitudinal opposite surfaces and two second longitudinal opposite surfaces; a first outflow passage has a first defining wall formed on each of the first respective longitudinal surfaces from the first side edge to the second side edge; a second outflow passage has a second defining wall formed on each of the second respective longitudinal surfaces from the third side edge to the fourth side edge; and the first and second outflow passages are structured so that the gas produces a specific combustion.

2. The flame port structure in Embodiment 1, wherein each of the first longitudinal surfaces is heaving, each of the second longitudinal surfaces is planar, and adjacent first and second longitudinal surfaces form the upper and lower walls of a respective one of the first outflow passage and the second outflow passage.

3. The system of any one of Embodiments 1-2, wherein the first continuous spiral strip is an extruded structure.

4. The system of any one of Embodiments 1-3, wherein each of the first longitudinal surfaces and each of the second longitudinal surfaces are both heaving to respectively have a first and a second convex-concave structures.

5. The system of any one of Embodiments 1-4, wherein the first convex-concave structure has a first convex portion, the second convex-concave structure has a second concave portion, and when the first and second convex-concave structures are vertically adjacent, the first convex portion is superimposed over the second concave portion to form one of the first and the second outflow passages.

6. The system of any one of Embodiments 1-5, wherein at least one of the first and second longitudinal surfaces is provided with a plurality of spacers.

7. A flame port structure for burning a gas, comprising a first continuous spiral strip having a first side edge, a second side edge and a first plurality of annular segments, wherein each of the first plurality of annular segments has two first longitudinal opposite surfaces; a first outflow passage has a defining wall formed on each of the first longitudinal surfaces from the first side edge to the second side edge; and the first outflow passage is structured so that the gas produces a specific combustion.

8. The flame port structure of any one of Embodiment 7, wherein the flame port structure further includes the second continuous spiral strip having a second plurality of annular segments, each of which has two second longitudinal opposite surfaces, and a third and a fourth side edges; a second outflow passage has a defining wall formed on each of the second longitudinal surfaces from the third side edge to the fourth side edge; and the second outflow passage is structured so that the gas produces the specific combustion.

9. The flame port structure of any one of Embodiments 7-8, wherein each of the first longitudinal surfaces has a specific repetitively heaving scheme; and each of the first annular segments includes at least one convex portion and one concave portion.

10. The flame port structure of any one of Embodiments 7-9, wherein the flame port structure is disposed in a stove; the stove includes a base and the flame port structure is arranged on the base; and the continuous spiral strip has two ends.

11. The flame port structure of any one of Embodiments 7-10, further including an internal edge and an external edge, between which the first outflow passage is disposed.

12. The flame port structure of any one of Embodiments 7-11, wherein the flame port structure is enclosed by a fuel-feeding cover; and between the fuel-feeding cover and the flame port structure, a fuel enters the internal edge through the first outflow passage from the external edge.

13. A method of making a flame port structure for burning a gas, comprising steps of providing a first elongate strip having a first transverse direction, two first longitudinal surfaces, a first side edge and a second side edge; and spirally winding the first elongate strip in the first transverse direction according to a first specific curvature to form a first plurality of annular segments.

14. The method of any one of Embodiment 13, further comprising during the winding step, at least one of the first longitudinal surfaces is caused to include convex portions and concave portions.

15. The method of any one of Embodiments 13-14, further comprising providing a second elongate strip having a second transverse direction, two second longitudinal surfaces, a third side edge and a fourth side edge; and spirally winding the second elongate strip in the second transverse direction according to a second specific curvature to form a second plurality of annular segments.

16. The method of any one of Embodiments 13-15, wherein each of the first longitudinal surfaces is planar, and at least one of the second longitudinal surfaces is heaving; a first outflow passage has a defining wall formed on one of the first longitudinal surfaces from the first side edge to the second side edge; a second outflow passage has a defining wall formed on a respective one of the second longitudinal surfaces from the third side edge to the fourth side edge; and a respective one of the first longitudinal surfaces and a corresponding one of the second longitudinal surfaces, when adjacent to each other, form one of the first outflow passage and the second outflow passage.

17. The method of any one of Embodiments 13-16, wherein the heaving second longitudinal surface includes a plurality of convex portions and a plurality of concave portions.

18. The method of any one of Embodiments 13-17, further comprising causing both second longitudinal surfaces to be heaving; causing the upper second longitudinal surface to form with an upper first annular segment a first outflow passage; and causing the lower second longitudinal surface to form with a lower first annular segment a second outflow passage.

19. The method of any one of Embodiments 13-18, wherein at least one of the first longitudinal surfaces and at least one of the second longitudinal surfaces each have a convex portion and a concave portion; and an upper convex portion of the respective first annular segment and a lower concave portion of the corresponding second annular segment, when put vertically adjacent, form one of the first and second outflow passages.

20. The method of any one of Embodiments 13-19, further comprising the first elongate strip and the second elongate strip have a first spiral space and a second spiral space respectively; and the first and second elongate strips are respectively put in the second and first spaces.

While the invention has been described in terms of what is presently considered to be the most practical and preferred embodiments, it is to be understood that the invention need not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A flame port structure for burning a gas, comprising:

a first continuous spiral strip having a first side edge, a second side edge and a first plurality of annular segments; and a second continuous spiral strip having a third side edge, a fourth side edge and a second plurality of annular segments, wherein:

each of the first plurality of annular segments and each of the second plurality of annular segments respectively have two first longitudinal opposite surfaces and two second longitudinal opposite surfaces;

a first outflow passage has a first defining wall formed on each of the first respective longitudinal surfaces from the first side edge to the second side edge;

a second outflow passage has a second defining wall formed on each of the second respective longitudinal surfaces from the third side edge to the fourth side edge; and the first and second outflow passages are structured so that the gas produces a specific combustion.

2. The flame port structure as claimed in claim 1, wherein each of the first longitudinal surfaces is heaving, each of the second longitudinal surfaces is planar, and the adjacent first and second longitudinal surfaces form the upper and lower walls of a respective one of the first outflow passage and the second outflow passage.

3. The flame port structure as claimed in claim 2, wherein the first continuous spiral strip is an extruded structure.

4. The flame port structure as claimed in claim 1, wherein each of the first longitudinal surfaces and each of the second longitudinal surfaces are both heaving to respectively have a first and a second convex-concave structures.

5. The flame port structure as claimed in claim 4, wherein the first convex-concave structure has a first convex portion, the second convex-concave structure has a second concave portion, and when the first and second convex-concave structures are vertically adjacent, the first convex portion is superimposed over the second concave portion to form one of the first and the second outflow passages.

6. The flame port structure as claimed in claim 1, wherein:

at least one of the first and second longitudinal surfaces is provided with a plurality of spacers.

7. A flame port structure for burning a gas, comprising:

a first continuous spiral strip having a first side edge, a second side edge and a first plurality of annular segments, wherein:

each of the first plurality of annular segments has two first longitudinal opposite surfaces;

a first outflow passage has a defining wall formed on each of the first longitudinal surfaces from the first side edge to the second side edge; and the first outflow passage is structured so that the gas produces a specific combustion.

8. The flame port structure as claimed in claim 7, wherein:

the flame port structure further includes a second continuous spiral strip having a second plurality of annular segments, each of which has two second longitudinal opposite surfaces, and a third and a fourth side edges;

a second outflow passage has a defining wall formed on each of the second longitudinal surfaces from the third side edge to the fourth side edge; and the second outflow passage is structured so that the gas produces the specific combustion.

9. The flame port structure as claimed in claim 7, wherein:

each of the first longitudinal surfaces has a specific repetitively heaving scheme; and each of the first annular segments includes at least one convex portion and one concave portion.

10. The flame port structure as claimed in claim 7, wherein:

the flame port structure is disposed in a stove;

the stove includes a base and the flame port structure is arranged on the base; and the continuous spiral strip has two ends.

11. The flame port structure as claimed in claim 7, further including an internal edge and an external edge, between which the first outflow passage is disposed.

12. The flame port structure as claimed in claim 11, wherein:

the flame port structure is enclosed by a fuel-feeding cover; and between the fuel-feeding cover and the flame port structure, a fuel enters the internal edge through the first outflow passage from the external edge.

* * * * *